US009029155B2

(12) United States Patent
Pomerantz et al.

(10) Patent No.: US 9,029,155 B2
(45) Date of Patent: May 12, 2015

(54) DIRECT MEASUREMENT OF FLUID CONTAMINATION

(75) Inventors: Andrew E. Pomerantz, Lexington, MA (US); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 242 days.

(21) Appl. No.: 12/785,116

(22) Filed: May 21, 2010

(65) Prior Publication Data

US 2011/0284219 A1 Nov. 24, 2011

(51) Int. Cl.

| | |
|---|---|
| ***E21B 49/10*** | (2006.01) |
| ***E21B 49/08*** | (2006.01) |
| ***E21B 49/00*** | (2006.01) |
| ***E21B 1/00*** | (2006.01) |

(52) U.S. Cl.
CPC . *E21B 49/10* (2013.01); *E21B 1/00* (2013.01); *E21B 49/08* (2013.01)

(58) Field of Classification Search
CPC ..... E21B 49/10; E21B 49/08; E21B 49/00; E21B 1/00
USPC ..... 436/25; 73/15.28, 152.23, 152.01; 166/264
See application file for complete search history.

(56) References Cited

U.S. PATENT DOCUMENTS

| | | | | |
|---|---|---|---|---|
| 3,835,927 | A * | 9/1974 | Oude Alink et al. | 166/304 |
| 5,266,800 | A * | 11/1993 | Mullins | 250/256 |
| 6,274,865 | B1 | 8/2001 | Schroer et al. | |
| 6,350,986 | B1 | 2/2002 | Mullins et al. | |
| 6,787,505 | B1 * | 9/2004 | Maitland et al. | 507/103 |
| 6,986,282 | B2 | 1/2006 | Ciglenec et al. | |
| 7,114,562 | B2 | 10/2006 | Fisseler et al. | |
| 7,305,306 | B2 * | 12/2007 | Venkataramanan et al. | 702/9 |
| 7,408,645 | B2 * | 8/2008 | DiFoggio | 356/436 |
| 2007/0265172 | A1 * | 11/2007 | Patel et al. | 507/221 |
| 2010/0081587 | A1 * | 4/2010 | van Zanten et al. | 507/235 |

* cited by examiner

*Primary Examiner* — Christine T Mui
(74) *Attorney, Agent, or Firm* — Kenneth L. Kincaid

(57) ABSTRACT

The present disclosure relates to apparatuses and methods to detect a fluid contamination level of a fluid sample. The method may comprise providing a fluid sample downhole from a subterranean formation, applying a reactant to the fluid sample to create a combined fluid, observing the combined fluid, and determining if contaminants are present within the fluid sample based upon the observing the combined fluid.

20 Claims, 10 Drawing Sheets

DIRECT MEASUREMENT OF FLUID CONTAMINATION

CROSS-REFERENCE TO RELATED APPLICATIONS

This application claims priority to U.S. patent application Ser. No. 12/783,954, filed May 20, 2010, the entire disclosure of which is hereby incorporated herein.

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the wellbore back to the surface.

In various oil and gas exploration operations, it may be beneficial to have information about the subsurface formations that are penetrated by a wellbore. For example, certain formation evaluation schemes include measurement and analysis of the formation pressure and permeability. Other measurements may include extracting fluid from the formation, and analyzing and/or testing samples of formation fluid. These measurements may be useful for predicting the production capacity and production lifetime of the subsurface formation.

Accordingly, a representative and/or accurate sample of the formation fluids may be desired. However, in the process of drilling, the drilling fluid may seep and/or permeate through the wellbore walls. In this event, the drilling fluid may contaminate a formation fluid near the wellbore wall. In order to obtain a representative and/or accurate sample of formation fluid, sufficient fluid may need to be pumped from the formation such that the amount of drilling fluid and/or contaminants in the pumped fluid may be reduced and a representative and/or accurate sample may be captured. After the contamination by drilling fluids is reduced, appropriate testing and/or analysis may be conducted on the fluid sample.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
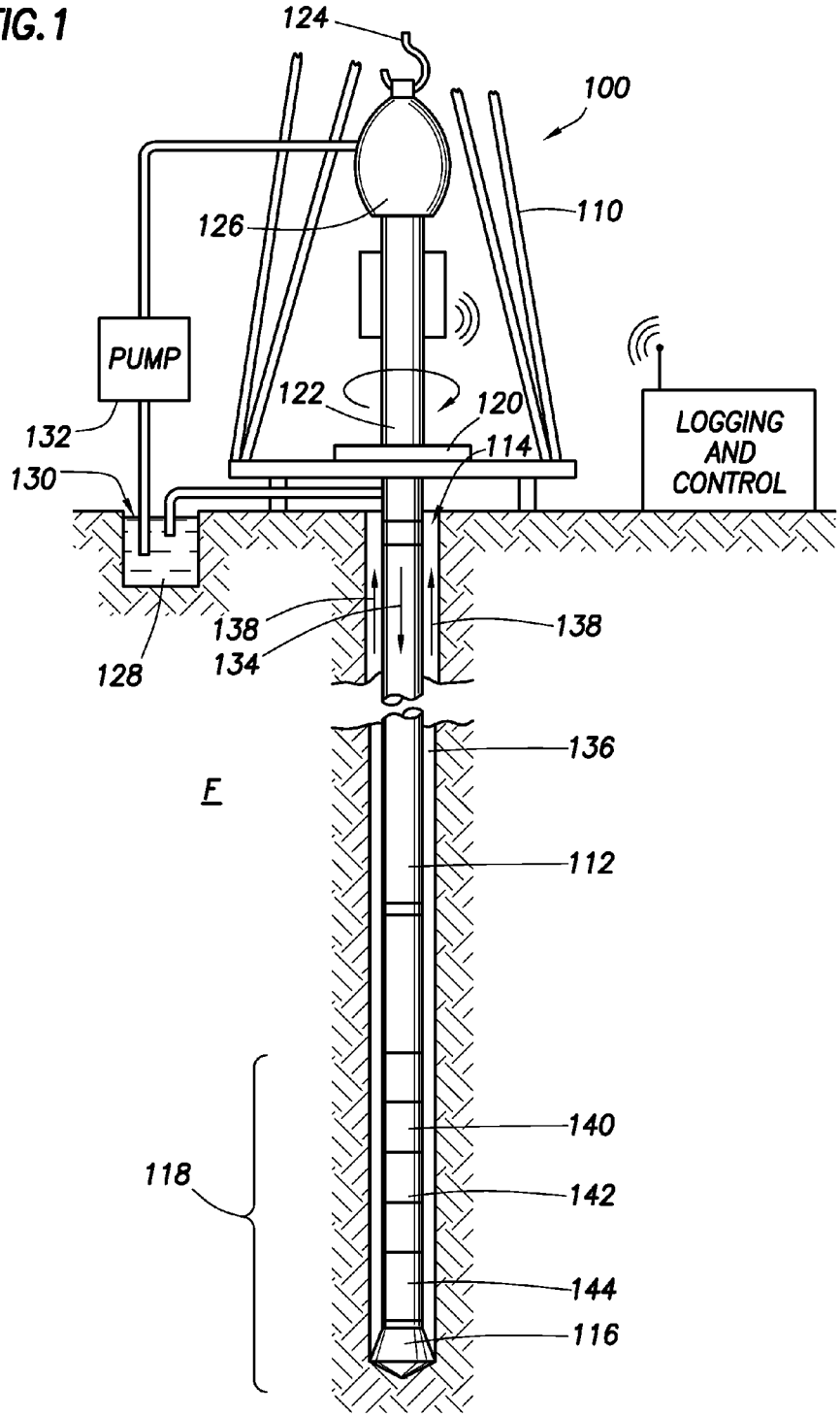
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a side view of a wellsite 100 having a drilling rig 110 with a drill string 112 suspended therefrom in accordance with one or more aspects of the present disclosure. The wellsite 100 shown, or one similar thereto, may be used within onshore and/or offshore locations. A wellbore 114 may be formed within a subsurface formation F, such as by using rotary drilling, or any other method known in the art. As such, one or more aspects in accordance with the present disclosure may be used within a wellsite, similar to the one as shown in FIG. 1 (discussed more below). Those having ordinary skill in the art will appreciate that the present disclosure may be used within other wellsites, other drilling operations, such as within a directional drilling application, or other logging operations without departing from the scope of the present disclosure.

Continuing with FIG. 1, the drill string 112 may suspend from the drilling rig 110 into the wellbore 114. The drill string 112 may include a bottom hole assembly 118 and a drill bit 116, in which the drill bit 116 may be disposed at an end of the drill string 112. The surface of the wellsite 100 may have the drilling rig 110 positioned over the wellbore 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

An upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. The pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, the drilling fluid 128 may exit the drill string 112 through one or more ports formed within the drill bit 116.

As such, the drilling fluid 128 may flow back upwardly through the wellbore 114, such as through an annulus 136 formed between the exterior of the drill string 112 and the interior of the wellbore 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the wellbore 114) back to the surface of the wellsite 100. As such, this drilling fluid 128 may be filtered and cleaned and/or returned back to the pit 130 for recirculation within the wellbore 114.

Though not shown, the drill string 112 may include one or more stabilizing collars. A stabilizing collar may be disposed within and/or connected to the drill string 112, in which the stabilizing collar may be used to engage and apply a force against the wall of the wellbore 114. This may enable the stabilizing collar to prevent the drill string 112 from deviating from the desired direction for the wellbore 114. For example, during drilling, the drill string 112 may "wobble" within the wellbore 114, thereby enabling the drill string 112 to deviate from the desired direction of the wellbore 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. The bottom hole assembly 118 may include components to communicate and relay information to the surface of the wellsite.

As such, as shown in FIG. 1, the bottom hole assembly 118 may include one or more logging-while-drilling ("LWD") tools 140 and/or one or more measuring-while-drilling ("MWD") tools 142. The bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100. The LWD tool 140 may include fluid analysis testers and/or other fluid testing tools and/or equipment.

The MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

Figure 2:
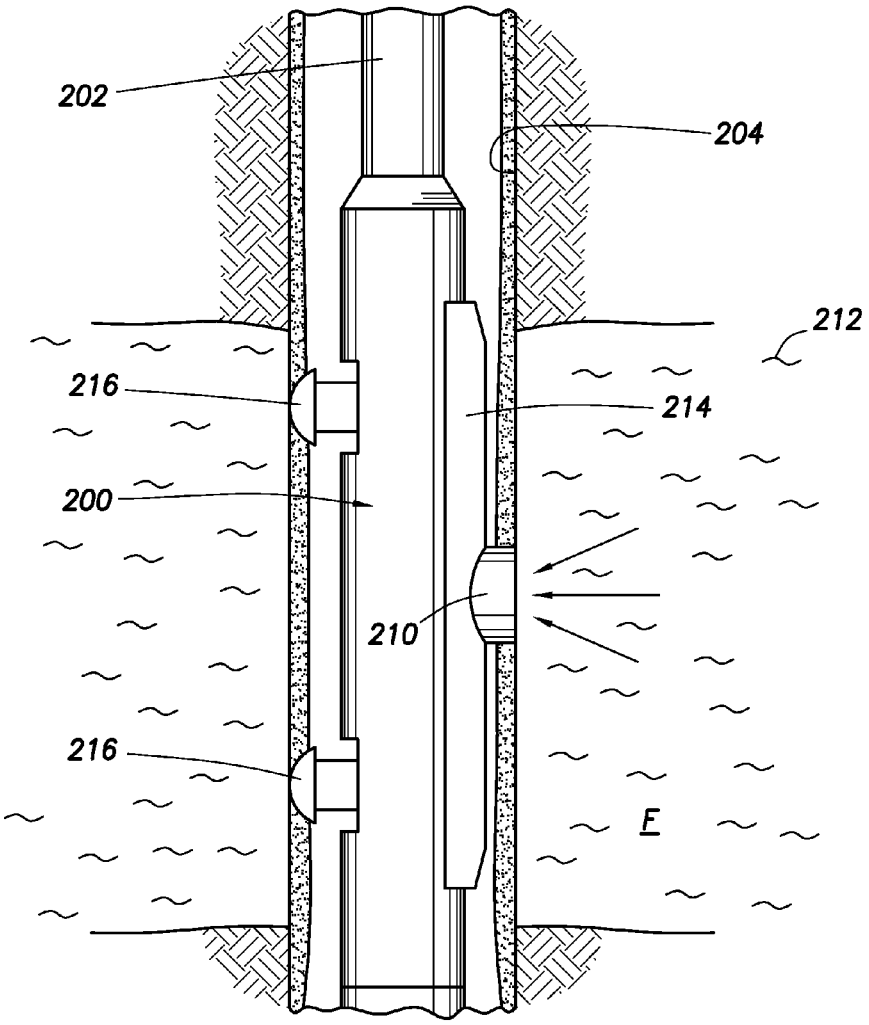
FIG. 2 is a schematic view of apparatus according to one or more aspects of the present disclosure.

Referring to FIG. 2, illustrated is a side view of a tool 200 in accordance with one or more aspects of the present disclosure. The tool 200 may be connected to and/or included within a drill string 202, in which the tool 200 may be disposed within a wellbore 204 formed within a subsurface formation F. As such, the tool 200 may be included and used within a bottom hole assembly, as described above.

Particularly, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 200 may include a probe 210 to hydraulically establish communication with the formation F and draw formation fluid 212 into the tool 200.

The tool 200 may also include a stabilizer blade 214 and/or one or more pistons 216. As such, the probe 210 may be disposed on the stabilizer blade 214 and extend therefrom to engage the wall of the wellbore 204. The pistons, if present, may also extend from the tool 200 to assist probe 210 in engaging with the wall of the wellbore 204. Alternatively, though, the probe 210 may not necessarily engage the wall of the wellbore 204 when drawing fluid.

As such, fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or wellbore 204. As such, a pumping system may be included within the tool 200 to pump the formation fluid 212 circulating within the tool 200. For example, the pumping system may be used to pump formation fluid 212 from the probe 210 to the sample bottles and/or back into the formation F. Alternatively still, rather than collecting formation fluid samples, a tool according to aspects disclosed herein may be used to collect samples from the formation F, such as one or more coring samples from the wall of the wellbore 204. The tool 200 may include fluid analysis testers and/or other fluid testing tools and/or equipment.

Figure 3:
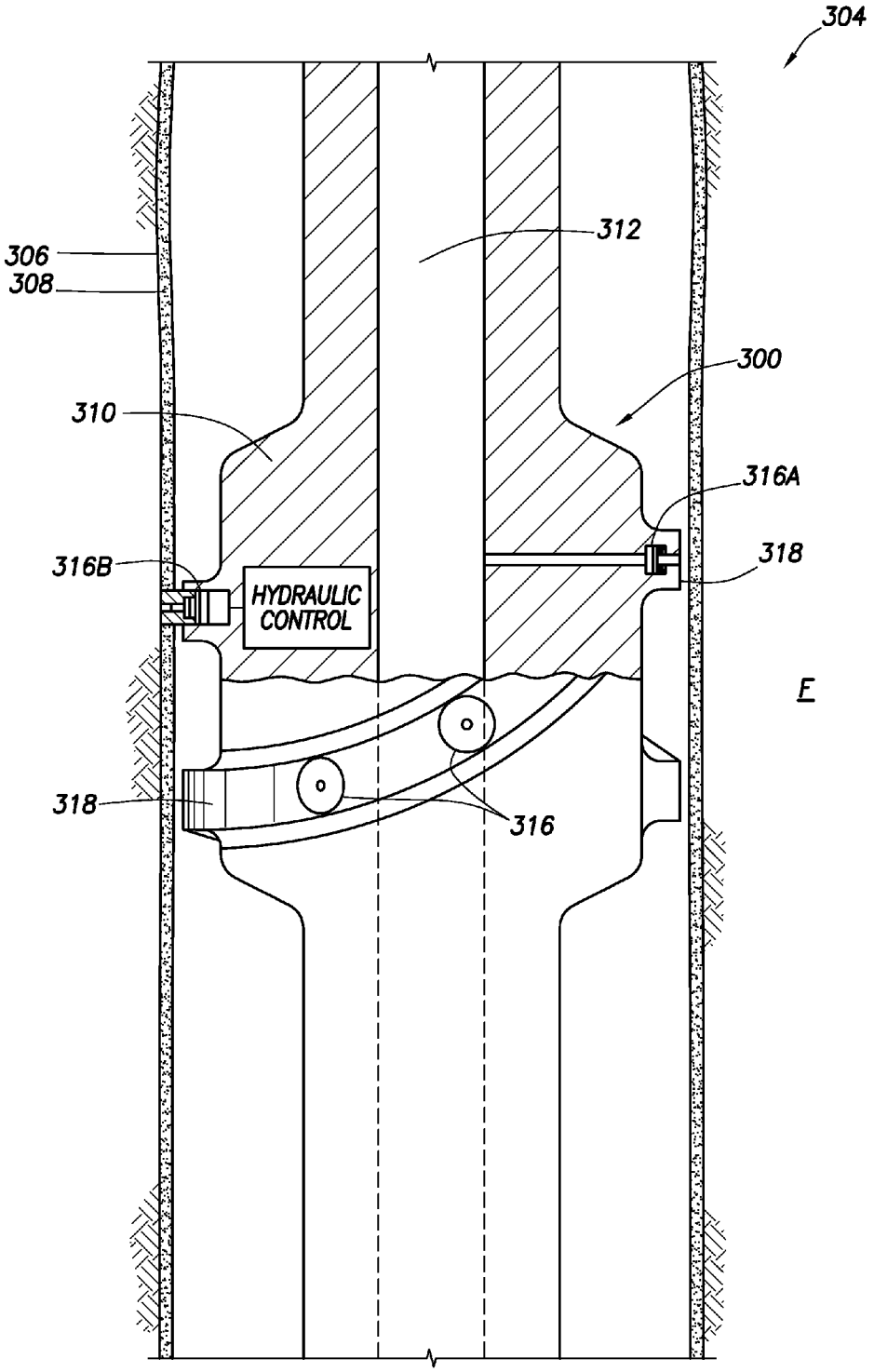
FIG. 3 is a schematic view of apparatus according to one or more aspects of the present disclosure.

Referring to FIG. 3, illustrated is a schematic view of a tool 300 in accordance with one or more aspects of the present disclosure. The tool 300 may be connected to and/or included within a bottom hole assembly, in which the tool 300 may be disposed within a wellbore 304 formed within a subsurface formation F.

The tool 300 may be a pressure LWD tool used to measure one or more downhole pressures, including annular pressure, formation pressure, and pore pressure, before, during, and/or after a drilling operation. Those having ordinary skill in the art will appreciate that other pressure LWD tools may also be utilized in one or more aspects of the present disclosure, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 300 may be formed as a modified stabilizer collar 310, similar to a stabilizer collar as described above, and may have a passage 312 formed therethrough for drilling fluid. The flow of the drilling fluid through the tool 300 may create an internal pressure $P_1$, and the exterior of the tool 300 may be exposed to an annular pressure $P_A$ of the surrounding wellbore 304 and formation F. A differential pressure $P_\delta$ formed between the internal pressure $P_1$ and the annular pressure $P_A$ may then be used to activate one or more pressure devices 316 included within the tool 300. As such, a pumping system may be included within the tool 300, such as including the pumping system within one or more of the pressure devices 316 for activation and/or movement of the pressure devices 316.

The tool 300 includes two pressure measuring devices 316A and 316B that may be disposed on stabilizer blades 318 formed on the stabilizer collar 310. The pressure measuring device 316A may be used to measure the annular pressure $P_A$ in the wellbore 304, and/or may be used to measure the pressure of the formation F when positioned in engagement with a wall 306 of the wellbore 304. As shown in FIG. 3, the pressure measuring device 316A is not in engagement with the wellbore wall 306, thereby enabling the pressure measuring device 316A to measure the annular pressure $P_A$, if desired. However, when the pressure measuring device 316A is moved into engagement with the wellbore wall 306, the pressure measuring device 316A may be used to measure pore pressure of the formation F.

As also shown in FIG. 3, the pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the wellbore 304 and/or a mud cake 308 of the wellbore 304. This may enable the pressure measuring device 316B to take measurements of the formation F also. The tool 300 may include fluid analysis testers and/or other fluid testing tools and/or equipment.

Other controllers and circuitry, not shown, may be used to couple the pressure measuring devices 316 and/or other components of the tool 300 to a processor and/or a controller. This processor and/or controller may then be used to communicate the measurements from the tool 300 to other tools within a bottom hole assembly or to the surface of a wellsite.

Figure 4:
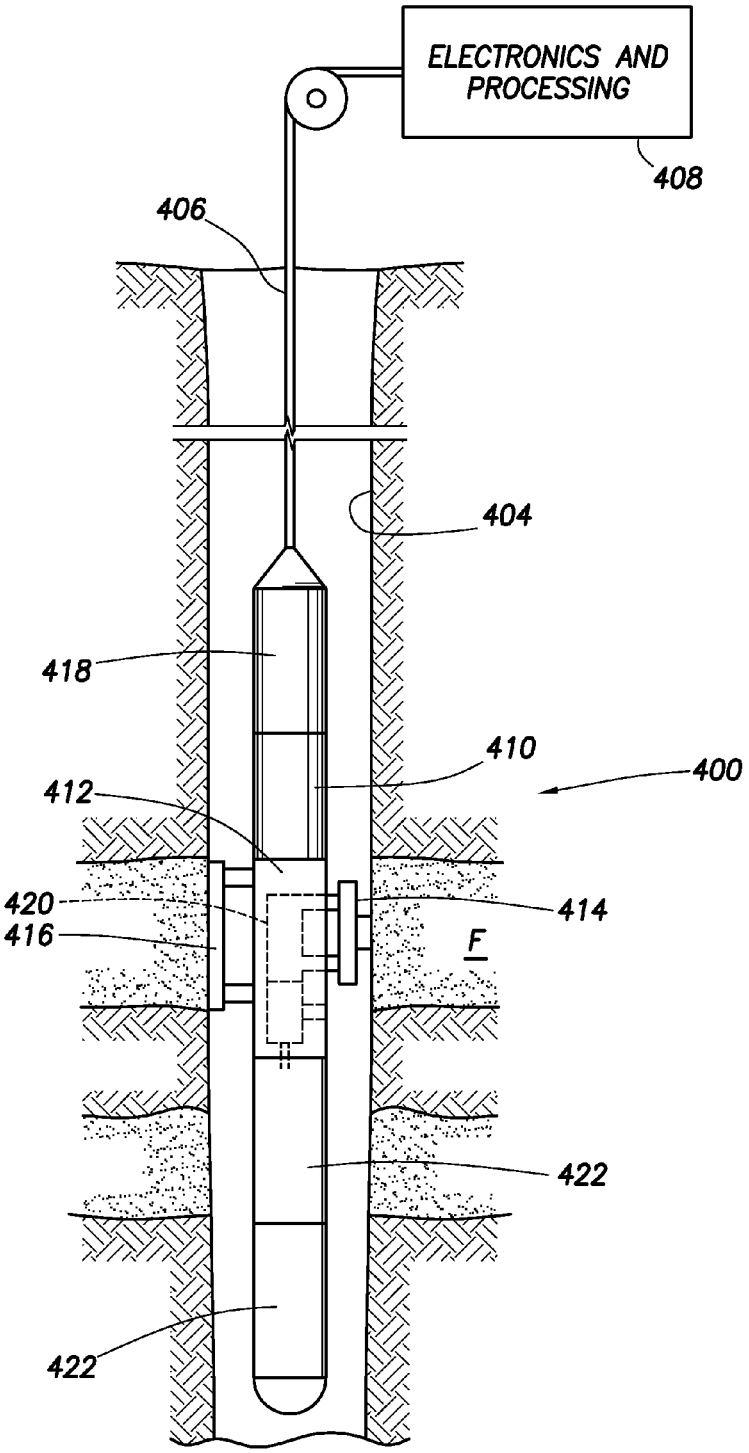
FIG. 4 is a schematic view of apparatus according to one or more aspects of the present disclosure.

Referring to FIG. 4, illustrated is a side view of a tool 400 in accordance with one or more aspects of the present disclosure. The tool 400 may be a "wireline" tool, in which the tool 400 may be suspended within a wellbore 404 formed within a subsurface formation F. As such, the tool 400 may be suspended from an end of a multi-conductor cable 406 located at the surface of the formation F, such as by having the multi-conductor cable 406 spooled around a winch (not shown) disposed on the surface of the formation F. The multi-conductor cable 406 is then coupled the tool 400 with an electronics and processing system 408 disposed on the surface.

The tool 400 may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the wellbore 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the wellbore 404 or formation F.

Figure 5:
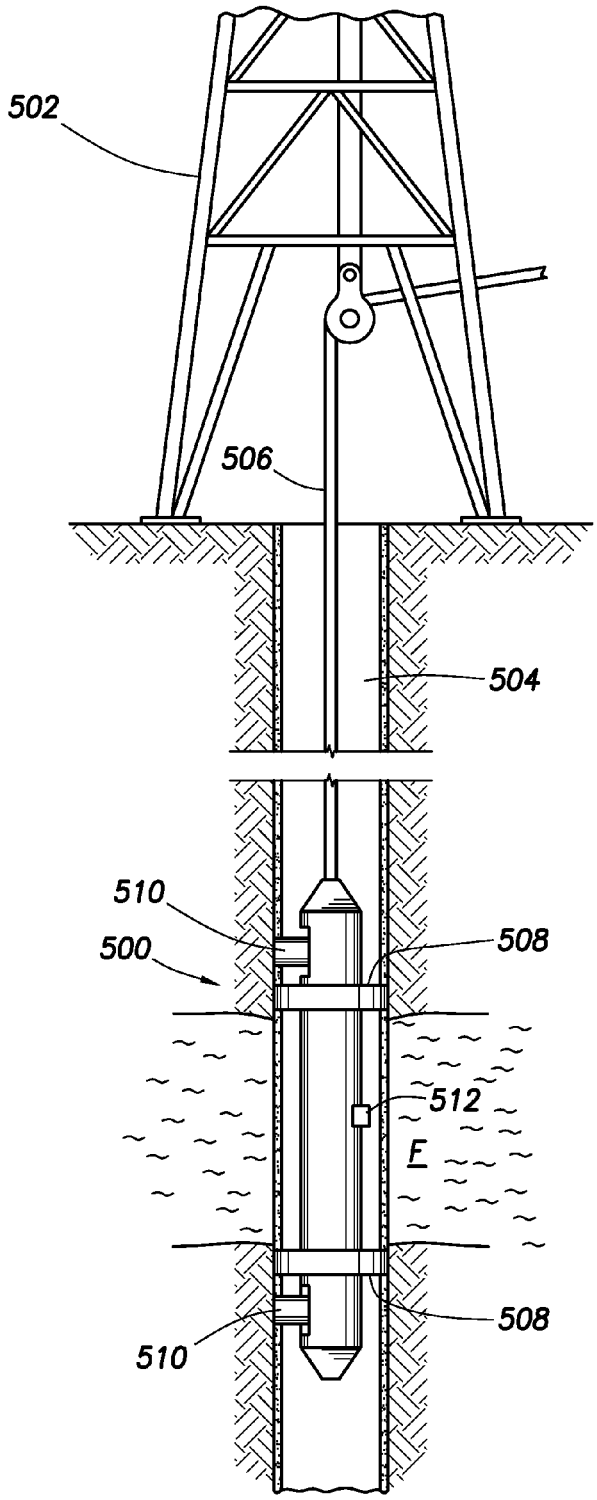
FIG. 5 is a schematic view of apparatus according to one or more aspects of the present disclosure.

Referring to FIG. 5, illustrated is a side view of another tool 500 in accordance with one or more aspects of the present disclosure. The tool 500 may be suspended within a wellbore 504 formed within a subsurface formation F using a multi-conductor cable 506. The multi-conductor cable 506 may be supported by a drilling rig 502.

As shown, the tool 500 may include one or more packers 508 that may be configured to inflate, thereby selectively sealing off a portion of the wellbore 504 for the tool 500. To test the formation F, the tool 500 may include one or more probes 510, and the tool 500 may also include one or more outlets 512 that may be used to sample and/or inject fluids within the sealed portion established by the packers 508 between the tool 500 and the formation F. The tool 500 may include fluid analysis testers and/or other fluid testing tools and/or equipment.

Figure 6:
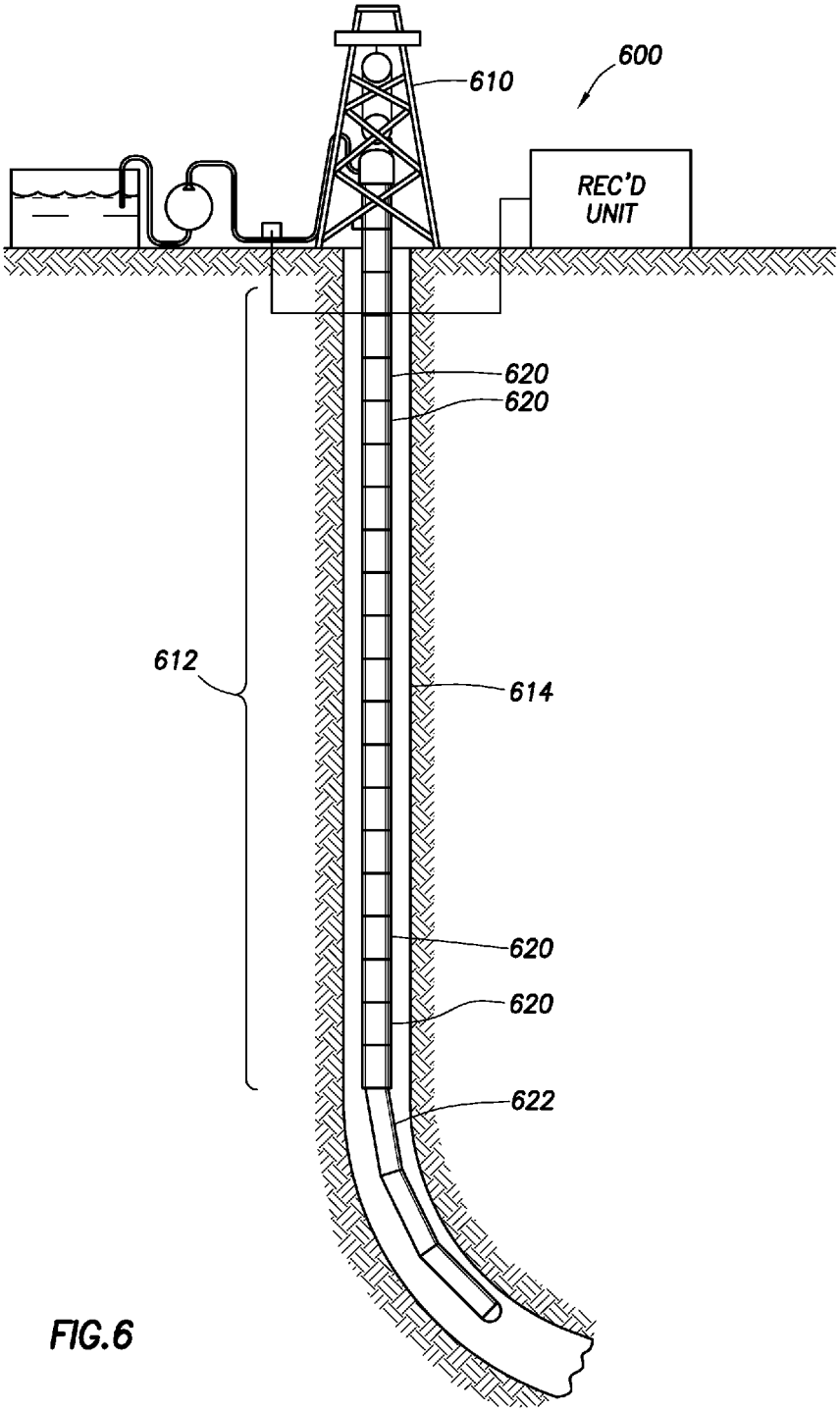
FIG. 6 is a schematic view of apparatus according to one or more aspects of the present disclosure.

Referring to FIG. 6, illustrated is a side view of a wellsite 600 having a drilling rig 610 in accordance with one or more aspects of the present disclosure. In this embodiment, a wellbore 614 may be formed within a subsurface formation F, such as by using a drilling assembly, or any other method known in the art. A wired pipe string 612 may be suspended from the drilling rig 610. The wired pipe string 612 may be extended into the wellbore 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. The wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 6, a string of multiple wellbore tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the wellbore 614, or, if desired, the tools 622 may be installed after drilling the wellbore 614. If installed after drilling the wellbore 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the wellbore 614. The tools 622 may then be positioned within the wellbore 614, as desired, through the selective movement of the wired pipe string 612, in which the tools 622 may gather measurements and data. These measurements and data from the tools 622 may then be transmitted to the surface of the wellbore 614 using the cable within the wired drill pipe 612. One or more of the tools 622 may include a fluid sampling tool. The fluid sampling tool may include analyzing tools, measurement tools, and/or any other equipment and/or tools necessary for sampling downhole fluids.

As such, a fluid sampling tool may be included within one or more of the apparatus shown in FIGS. 1-6, in addition to being included within other tools and/or devices that may be disposed downhole within a formation. The fluid sampling tool, thus, may be used to determine characteristics of fluids extracted from the formation (e.g., fluid samples). A characteristic of particular interest may include a level of contamination of fluid samples. As well known, contaminants may affect the purity of fluid samples extracted during formation fluid sampling. Accordingly, the fluid samples may not be representative of pristine formation fluids. Contaminants that may be present within fluid samples may include drilling fluids, such as drilling mud and/or drilling mud filtrate. For example, drilling mud may penetrate the formation and contaminate formation fluid. Accordingly, one or more aspects of the present disclosure are directed to determining a level and/or amount of contamination by drilling fluids, a portion of contaminant, and/or a concentration of contaminant in a fluid sample.

A concern in the collection and recovery of downhole fluid samples may be ensuring that the samples are minimally contaminated by drilling fluids, such that the samples may be representative of the formation fluids. Effective sampling techniques may be used to ensure an acceptable level of contamination and/or purity of the fluid samples. Thus, an accurate measurement of the contamination level of the extracted fluid may be useful to maximize the efficiency of the fluid sampling process, such as pumping or extraction of fluid from the formation. An acceptable level of contamination may be no contamination (a pure sample) and/or may be a level greater than zero. For example, an acceptable level of contamination may be one at which contaminants are not detectable, or at which the amount or concentration of contaminants is low enough so that the contaminants may not significantly influence any analysis of the sample, including, but not limited to, the composition and/or physical properties of the sample. Accordingly, one or more aspects of the present disclosure are directed to reducing the amount of contaminants during a sampling process based on an accurate estimate of the level of contamination in the fluids extracted from a formation. As such, a contaminated fluid may be discharged into the wellbore, and additional fluid may be pumped or extracted from the formation for various periods of time in order to provide other fluid samples. A sufficient volume of formation fluid may be pumped or extracted so as to obtain an acceptable fluid sample that is representative of the formation fluids, and the acceptable fluid sample may be stored in the fluid sampling tool. Thus, determinations of the level or amount of contamination may be performed repeatedly on successive fluid samples until an amount, a portion or a concentration of the contaminants in the fluid sample reaches an acceptable level.

As well known, the composition of the fluid extracted from the formation may change as a result of a duration or volume of pumping. Typically, the composition of the extracted fluid may be similar to mud filtrate and/or drilling mud at short pumping times or small pumped volumes, and may be similar to formation fluid (e.g, crude oil) at long pumping times or large pumped volumes. Accordingly, the composition of the fluid extracted from the formation may be measured as a function of time or a function of pumped volume.

The measured composition as a function of time or pumped volume may then be fit to a semi-empirical model of flow of drilling fluids and formation fluid from the formation and into the sampling tool, and the amount of contamination may be estimated from one or more fitting parameters of the model. For example, one method of estimating a level of contamination involves oil-based mud contamination monitoring (OCM) modeling. A partial composition of fluid extracted from the formation may be measured repeatedly during extraction of the fluid from the formation. The partial composition may be measured using downhole fluid analyzers, which may, in one or more aspects, involve optical spectrometers. For example, estimation of contamination may be made in accordance with the methods and apparatuses of U.S. Pat. No. 6,350,986, filed on Apr. 27, 1999, entitled "Analysis of Downhole OBM-Contaminated Formation Fluid," and U.S. Pat. No. 6,274,865, filed on Feb. 23, 1999, entitled "Analysis of Downhole OBM-Contaminated Formation Fluid," each assigned to the present assignee and incorporated herein by reference in their entireties. However, the estimation of contamination using models such as OCM model is usually not a direct measurement of the contamination, in the sense that the measured partial composition may not include the direct measurement of the amount of contaminant. Instead, the measured partial composition may include amounts of substances present in the formation fluid and usually not present in the contaminants. For example, an OCM model may be employed to estimate and/or model a contamination level based on asphaltene and/or gas content within successive fluid samples that may be obtained during a sampling process. As such, the OCM model may provide indirect estimates of contamination levels as a function of time.

In view of the above, a method in accordance with one or more aspects of the present disclosure may involve, at least, making direct measurements of the contamination of fluid samples. For example, the method may involve determining if contaminants by drilling fluids are present within a fluid sample based on an observation of a reaction between the contaminants in a fluid sample and a reactant. The reaction may be initiated by the combination of the reactant and the fluid sample. The method may further involve determining an amount of contaminants by drilling fluids within the fluid sample.

The reactant may include an oil-based mud reactant, that is, a reactant configured to react with oil-based muds. For example, the reactant may include an olefin reactant, that is, a reactant configured to react with olefins. In accordance with one or more aspects of the present disclosure, the method may be employed to determine contamination of fluid samples when synthetic drilling muds have been used to drill the wellbore, or are otherwise present in the wellbore. An example of a synthetic drilling mud may be Nova Plus drilling fluid produced by M-I SWACO, which is a synthetic oil-based mud containing olefins. In contrast to the Nova Plus drilling fluid, crude oil, which may be a formation fluid of interest, may substantially lack the presence of olefins. Therefore, a process that determines the presence of olefins may be used to determine if a fluid sample is contaminated with Nova Plus drilling fluid. Those skilled in the art will appreciate that contamination by other oil-based muds containing olefins may be detected and/or measured by processes in accordance with the present disclosure. Further, those skilled in the art will appreciate that olefins may not be the only indicia of contamination by drilling fluids. For example, esters (or other indicia of drilling fluids) may be contained in a synthetic oil based mud, and may be detected and/or measured by processes in accordance with the present disclosure.

In accordance with one or more aspects of the present disclosure, the reactant may be one of potassium permanganate ($KMnO_4$) and bromide. When the reactant is potassium permanganate and the drilling fluid contains olefins, as described above, the reactant may react with the drilling fluid in an observable manner. For example, an optical absorption spectrum of the combination of the reactant and the fluid sample fluid may be measured by a downhole optical spectrometer. The observed spectrum may then be evaluated and/or compared with known spectra and/or values, such that a level of contamination may be determined.

In accordance with one or more aspects of the present disclosure, the method of making a direct contamination level measurement may be used in concert with other contamination methods that estimate the composition of the fluid extracted from the formation as a function of time or pumped volume, fit the composition data points to a semi-empirical model of flow of drilling fluids and formation fluid, and estimate the amount of contamination from fitting parameters of the model. For example, an OCM model may indicate a point during a pumping process that may be of interest, such as a point corresponding to a projected contamination level below a predetermined value, and/or a change of contamination below a predetermined value. For example, the OCM model may indicate when the contamination level may be estimated at 5% to 10% contamination. Then, when the point of interest is reached, a direct contamination measurement may be taken to confirm the contamination level and/or to provide additional and/or detailed information at the point of interest. Accordingly, measurements in accordance with the present disclosure may be made quickly, efficiently, and may accurately measure the level of contamination.

As such, a determination regarding a duration or volume of pumping may be improved during the sampling process based on the level of contamination measured with direct methods disclosed herein. Pumping duration or volume may be modified such that a level of acceptable contamination may be achieved efficiently. Accordingly, fluid extracted from the formation may reach an acceptable level of contamination in an efficient and/or timely manner and time may not be wasted through additional pumping and/or contamination analysis.

Figure 7:
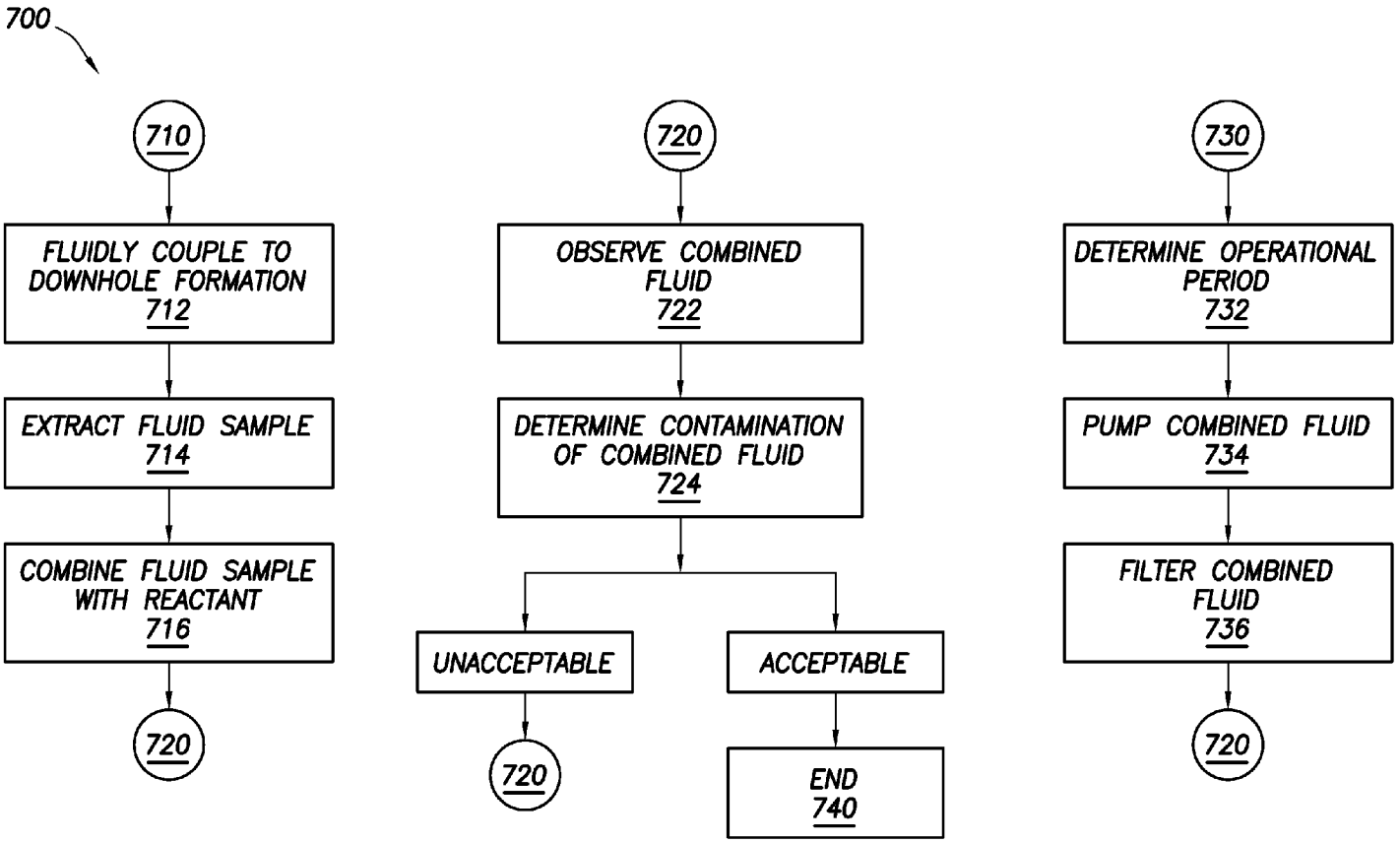
FIG. 7 is a flow-chart diagram of a method according to one or more aspects of the present disclosure.

Referring to FIG. 7, illustrated is a method 700 of formation fluid sampling in accordance with one or more aspects of the present disclosure. As noted above, it may be desirable to obtain fluid samples that are representative of the formation fluids. As the fluid sample are usually extracted from a region of the formation that is located near the wellbore, the fluid samples may therefore be contaminated by drilling fluids, such as drilling mud, drilling mud filtrate and/or other contaminants. Accordingly, it may be desirable to determine the amount of contamination in the fluid samples. Thus, a downhole fluid sample tool may be positioned in a wellbore formed into a subterranean formation. The downhole fluid sampling tool may include contaminant removal apparatuses, pumping systems and/or apparatuses, measuring and/or analyzing tools, and/or any other downhole tools and/or equipment as may be desired. The downhole fluid sampling tool may be any tool or may include any mechanism known in the art or future-developed without departing from the scope of the present disclosure. For example, the downhole fluid sampling tool may be included within one or more of the apparatus shown in FIGS. 1-6.

The method 700 may begin with process 710 for providing a first fluid sample. The process 710 may include positioning a fluid sampling tool adjacent to a formation of interest within a wellbore, extracting fluid from the formation, monitoring the contamination of extracted fluids, and capturing the fluid sample from the formation with the fluid sampling tool based on the monitored contamination.

For example, the process 710 may start by fluidly coupling the fluid sampling tool to a formation at step 712. To fluidly couple the fluid sampling tool to the formation, the sampling tool may be actuated to anchor in a wellbore wall at the location to be tested. The sampling tool may then be actuated such that the sampling tool, or a portion thereof, may establish fluid coupling between the fluid sampling tool and the formation. For example, the fluid sampling tool may include one probe assembly configured to contact and/or penetrate the formation. The fluid coupling between the fluid sampling tool and the formation may be established via at least one flow inlet of the probe assembly. Thus, the probe assembly may permit fluid to be extracted from the formation and/or fluid samples to be retrieved in the fluid sampling tool. Optionally, the probe assembly may be combined with additional tools (e.g., drilling tools, heating tools) and/or other probes (e.g., injection probes) so that fluid samples may efficiently be retrieved in the fluid sampling tool. Examples of probe assemblies include, but are not limited to, the probe 800 and 900 shown in FIGS. 8A-B and 9A-B respectively. However, one with ordinary skill will appreciate that other arrangements and/or mechanisms may be used to establish fluid coupling between the fluid sampling tool and the formation without departing from the scope of the present disclosure.

After fluid coupling at step 712, fluid may be extracted from the formation 714. For example, fluid may be extracted from the formation by use of passive means, such as pressure difference between the formation fluid and the downhole tool, and/or active means, such as pumps. However, those skilled in the art will appreciate that any known or future developed means of fluid extraction may be used without departing from the scope of the present disclosure.

As previously noted, contaminants may be present in the extracted fluid, thereby potentially effecting any measurement performed on samples of the extracted fluid. To obtain a fluid sample that is representative of the formation fluid, and/or not excessively contaminated by drilling fluids, fluid may be extracted or pumped for a duration or a volume before the fluid sample is obtained. At a point of interest in the fluid extraction process, the fluid sample may be obtained. To maximize efficiency, it may be desired to balance minimizing the pumping time with maximizing the purity of the sample. Accordingly, fluid may be pumped or extracted and the contamination of extracted fluid may be monitored, for example using techniques such as OCM modeling. Examples of points of interest include a point corresponding to a projected contamination level estimated with OCM modeling is below a predetermined value, and/or a change of contamination estimated with OCM modeling is below a predetermined value. Other points of interest may also be used within the scope of the present disclosure, including, but not limited to, points corresponding to predetermined pumping time or pumped volume.

Optionally, the extracted fluid may be pumped through a contaminant removal apparatus, such as a filtration device or other device at step 716. However, any methods and/or processes that may remove contaminants from the extracted fluid sample may be used within the scope of the present disclosure After providing the fluid sample from a downhole formation at step 714, the method 700 may proceed to process 720 to analyze the fluid sample, for example to determine whether the fluid sample is representative of the downhole formation. In the process 720, a fluid sample that may have been extracted and contained within a downhole fluid sampling tool may be tested, analyzed, and/or observed. Also, the process 720 may be used to determine an amount and/or level of contamination by direct means.

As part of the process 720, the fluid sample may be combined with a reactant at step 722. The reactant may be a selected substance, chemical, and/or compound that is known to react with the particular type of drilling fluid that is or was used during drilling of the wellbore, or otherwise introduced in the wellbore. Alternatively, the reactant may be a substance, chemical, and/or compound that is known to react with a particular fluid which presence in the fluid sample is related to and/or correlated with the presence of contaminants in the fluid sample.

The combination of the fluid sample with the reactant may be performed by any means known in the art or future-developed. For example, the step 716 may include applying a reactant to the fluid sample, thereby creating a combined fluid. The combined fluid is a combination and/or mixture of the fluid sample fluids and the reactant. Application of the reactant to the fluid sample may include injection, stirring, mixing, shaking, and/or any other method or process of contacting a fluid sample with a reactant. Accordingly, the reactant may be a fluid, such as a liquid or gas, or may be a solid, such as a powder, or may be any other physical state.

During the step of applying the reactant to the downhole fluid sample, the fluid sample may be disposed in a sample chamber of the downhole sampling tool. The sample chamber may be configured such that the reactant may be injected from a reactant holding chamber into the sample chamber. Alternatively, the reactant may be injected into a fluid line and/or flow line during circulation or holding of the fluid sample within the line of the downhole sampling tool. Alternatively, the fluid sample may be conveyed to the surface by means of a flow line and/or extraction of a sample chamber or the downhole tool such that fluid testing may occur at the surface of the wellsite. Alternatively, the fluid sample may be introduced to a reactant holding chamber such that mixing and/or combination of the fluid sample with the reactant may take place within the reactant holding chamber. Those skilled in the art will appreciate that the reactant and fluid sample may be combined by any means known in the art without deviating from the scope of the present disclosure.

Mechanical means may be provided to allow for stirring, shaking, and/or mixing of the combined fluid (the reactant and the fluid sample). Power for shaking, stirring, and/or other mixing and/or combining means and/or methods may be provided within the downhole sampling tool, may be provided from other downhole tools, may be provided from the well site surface, and/or may be provided using any other method and/or arrangement known in the art.

After the combined fluid (the fluid sample combined with the reactant) is generated at step 716, a direct contamination level may be measured. For example, the reactant may have a known reaction with drilling fluids such that if a reaction (or result thereof) is observed, the presence and/or amount of contaminants, such as drilling fluids, in the combined fluid may be determined. As such, to determine the level of contamination, the combined fluid may be observed and/or analyzed at step 724.

Accordingly, a detector and/or sensor may be coupled to the downhole sampling tool or to any apparatus containing the combined fluid generated from the sampling fluid and the reactant, such that the detector and/or sensor may observe the combined fluid. For example, the detector and/or sensor may be positioned such that the combined fluid may flow to or be passed adjacent to the detector and/or sensor. Alternatively, the detector and/or sensor may be sensitively (e.g., optically, thermally, etc. . . . ) coupled to a sample chamber containing the combined fluid. Those skilled in the art will appreciate that other configurations for the detector and/or sensor may be used without deviating from the scope of the present disclosure.

As noted, a physical property may change in the combined fluid as the reactant is applied to the fluid sample. To detect the change of physical property in the combined fluid, the detector, may observe the fluid sample prior application of the reactant. The detector may observe the change of the value of the physical property during application of the reactant to the fluid sample. The detector may make an observation of the physical property of the combined fluid after the reactant is applied and/or mixed with the downhole fluid sample. Optionally, the detector may observe the physical property of the reactant prior mixed with the downhole fluid sample. Additionally, a non-reactive substance may be combined with a portion of the fluid sample to provide a reference.

In one or more aspects disclosed herein, the observation performed at step 722 may include optical absorption spectroscopy of the combined fluid. Accordingly, after combination of the fluid sample and reactant to create the combined fluid at step 716, the combined fluid may be observed at 722, such as by an optical spectrometer. The optical spectrometer may observe optical absorption at particular wavelengths (e.g. an optical spectrum) such that the presence and/or absence of a particular chemical and/or compound may be determined at step 724. For example, the optical spectrometer may observe a first optical spectrum when contaminants are present within the combined fluid, and may observe a second optical spectrum different from the first optical spectrum when no contaminants are present within the combined fluid. Those skilled in the art will appreciate that other physical properties of the combined fluid may be detected to determine a level of contamination without departing from the scope of the present disclosure. For example, a reactant may be used that may fluoresce at particular wavelengths only in one of the absence or the presence of contaminants. Accordingly, the reactant may chemically and/or physically react in a detectable manner (e.g, detectable temperature change) such that the combined fluid may be observed to determine if the fluid sample is contaminated and/or to determine a level of contamination present in the fluid sample.

In cases where the detector observes the optical spectrum of the combined fluid, the reactant may be a material, chemical, and/or other compound that, when combined with the downhole fluid and/or drilling fluids, changes color. For example, the color of the combined fluid may change from a first color if contaminants are not present in the combined fluid, to a second color if contaminants are present in the combined fluid. Accordingly, optical absorption at specific wavelengths may only be detected in the presence and/or absence of contaminants by drilling fluids present in the combined fluid, or the strength of the optical absorption may depend on the amount of contaminants by drilling fluid present in the combined fluid. Also, the color of the combined fluid may also gradually change between the first and second colors, and thus, may indicate a level of contamination.

For example, a potassium permanganate ($KMnO_4$) dye may be used as a reactant. Potassium permanganate may change color in the presence of olefins that may be contained a synthetic drilling fluid. During use of potassium permanganate as the reactant, if substantially no olefins are present, the combined fluid may be a dark or purple color. However, in the presence of olefins, indicating the presence of contaminants by drilling fluids in the fluid sample, the combined fluid may change to a light color, such as be yellow or colorless. In this example, the change in color may occur due to the dye absorbing certain wavelengths of light. When no contaminants are present, the dye may absorb particular wavelengths, thus providing a dark color, such as purple. When olefins are present in the fluid sample, the olefins may chemically react with the dye such that the light absorption characteristic (such as at a particular wavelength) may be neutralized and/or removed. Those skilled in the art will appreciate that other dyes, chemicals, compounds, and/or reactants may be employed without deviating from the scope of the present disclosure. For example, bromine may be used to detect the presence of olefins in a downhole fluid sample. Additionally, the performance of a reactant may be altered by adjusting variable factors, such as pH. Accordingly, it may be possible to detect a level of contamination by altering or changing characteristics of the reactant, thereby changing the performance of the reactant.

As noted, the process 720 may include observing the combined fluid at step 722 such that a level of contamination of the fluid sample may be determined at step 724. Pursuant to aspects of the present disclosure, the amount of reacted dye may depend on the concentration of olefin-based synthetic drilling fluids in the fluid sample. A low concentration of olefins may provide only a small amount of reactions with the dye, and, therefore, the color of the combined fluid may be dark. A high concentration of olefins may provide a large amount of reactions with the dye, and, therefore, the color of the combined fluid may be light. The concentration of olefin-based synthetic drilling fluids in the fluid sample may be equivalent to or represent the amount, concentration, and/or level of contamination in the fluid sample. Accordingly, by measuring how much light is absorbed in the combined fluid, the amount of dye that has not chemically reacted with olefins may be determined.

Alternatively or additionally, absorption spectra, which may be observed in situ with the detector provided with the downhole sampling tool or pre-recorded in a database accessible to a processor of the downhole fluid sampling tool, may be compared to determine the level of contamination of the fluid sample. Only particular wavelengths may be observed, and the strength of the absorption at the particular wavelength may be indicative of the amount, concentration, and/or level of contamination.

For example, a first spectrum may be observed on a mixture of the reactant and the drilling fluid. A second spectrum may be observed on the reactant combined with a known crude oil that may be representative of the formation fluid. Additional spectra may be observed on mixtures having known levels of contamination, known amounts of drilling fluid in the known crude oil, and/or known ratio or percentages of drilling fluid and crude oil. Accordingly, a spectra database may be generated. Each record of the spectra database may be associated and/or assigned to particular levels of contamination such that a processor or other computer may be used to determine the level of contamination of the fluid sample. In operation, a spectrum observed on the combined fluid may be compared to the spectra in the database to determine the level of contamination. Those skilled in the art will appreciate that any known means and/or method of comparison may be employed without departing from the scope of the present disclosure.

As mentioned before, an acceptable sample may be one that is representative of the formation fluids, and a contaminated sample may be one that has drilling fluids included therein at a level that is unacceptable for formation fluid analysis. For example, if an observed absorption spectrum indicates a level higher than the predetermined level, the sample may be unacceptable, but if the observed absorption spectrum indicates a level lower than the predetermined level, the sample may be acceptable. Accordingly, if the operations performed at step 724 show an acceptable level of contamination, the method 700 may end at step 740. However, if the level of contamination is determined to be unacceptable, the method 700 may continue to process 730 in which a second fluid sample is obtained. It should be noted that an acceptable level of contamination may be zero contamination in some cases, and be a non zero level in other cases.

When the method 700 ends at step 740, the result may be a fluid sample that is representative of the formation fluids from which the sample was extracted. The representative fluid sample may accurately represent the formation fluids, and may be stored in the downhole fluid sampling tool, and/or further analyzed, tested, measured, any other analytical measurement may be performed with the sample.

The process 730 may include determining an additional pumping duration or pumped volume at step 732. To determine how long or how much fluid should be additionally pumped or extracted from the formation, the contamination determined at step 726 may be used. For example, if the spectrum observed at step 724 indicates a high level of contamination, additional pumping for a relatively longer pumping duration or for a relatively larger pumped volume may be performed to reduce the contamination level of a second fluid sample. Conversely, if the spectrum observed at step 724 indicates a low level of contamination, then additional pumping for a relatively shorter pumping duration or for a relatively smaller pumped volume may be performed to minimize the time spent to acquire a representative fluid sample.

In addition, the step 732 may be performed using a semi-empirical model of flow of drilling fluids and formation fluid in the formation, such as used in an oil-based mud contamination monitoring (OCM) model. In contrast to OCM model, the one or more fitting parameters of the model may be fitted to the contamination level determined directly at step 726, thereby calibrating the model. The calibrated model may then be used to determine how long or how much fluid should be additionally pumped or extracted from the formation until a new direct measurement of the contamination level is warranted. Accordingly, combining fluid sample with the reactant may occur only at point of interest determined by a semi-empirical model, such as the OCM model.

Accordingly, after a level of contamination is determined at 726, the step 734 of pumping for a specified operational period as determined at 732 may be performed. The operational period may be set at a predetermined amount of time, which may be based on the level of contamination at 726, or to other values discussed herein. The pumping may move the combined fluid through the downhole tool, through flow lines and/or fluid chambers, and/or may pump the combined fluid into the wellbore.

After additional fluid is extracted from the formation at step 734, filtering at step 736 may optionally be performed. A portion of the additional fluid extracted from the formation may be pumped through a contaminant removal apparatus so that the contaminants may be removed. Those skilled in the art will appreciate that filtering 736 may be omitted as pumping of the fluid may, over the operational period, reduce the contamination of the fluid extracted from the formation.

After the second fluid sample is obtained at step 734, the method 700 may return to process 720, such that the second fluid sample may be analyzed. As such, a new combined fluid may be generated at step 722, the new combined fluid may be observed at step 724, and a new determination of the level of contamination may be made at 726. If the level is now acceptable, the method 700 may end at step 740. However, if the level is still unacceptable, the method 700 may return to process 730 for more pumping at step 734 and optionally filtering at step 736. In these cases, the amount of time/volume of pumping performed at step 734 and determined at step 732 may be adjusted according to the new level of contamination, thereby maximizing efficiency of sampling.

Figure 8A:
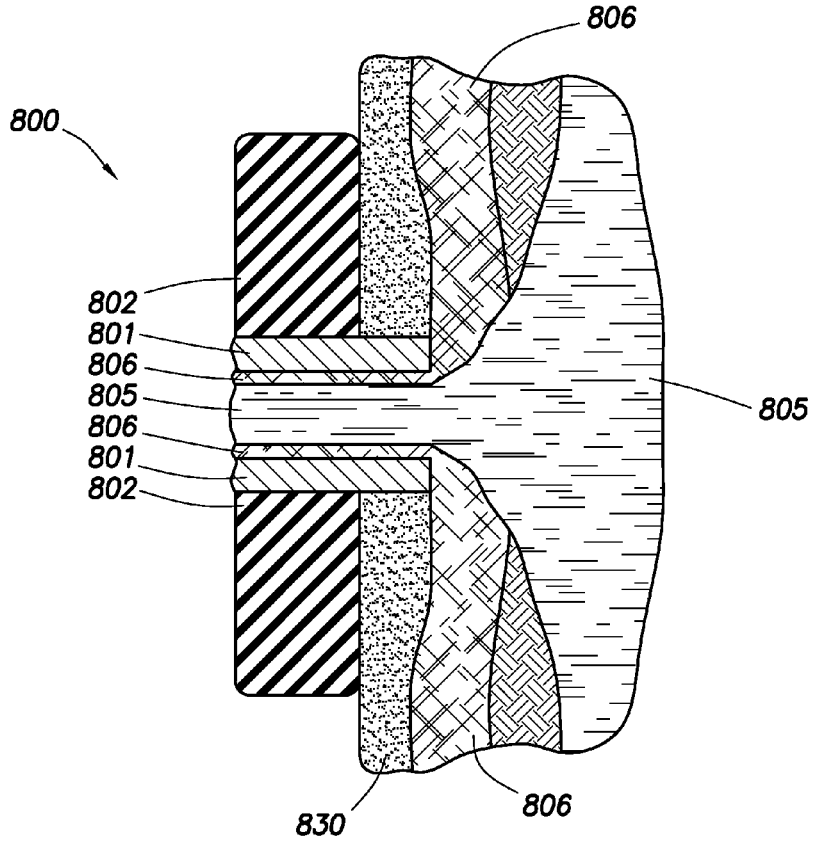
FIGS. 8A and 8B are schematic views of apparatus according to one or more aspects of the present disclosure.
Figure 8B:
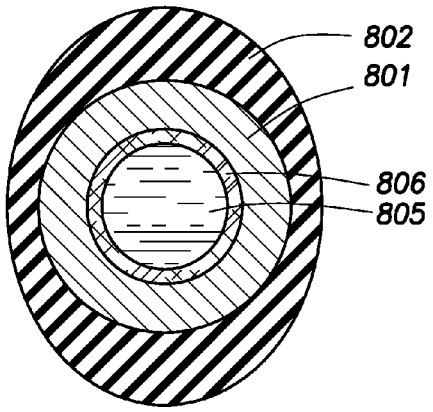
Figure 9A:
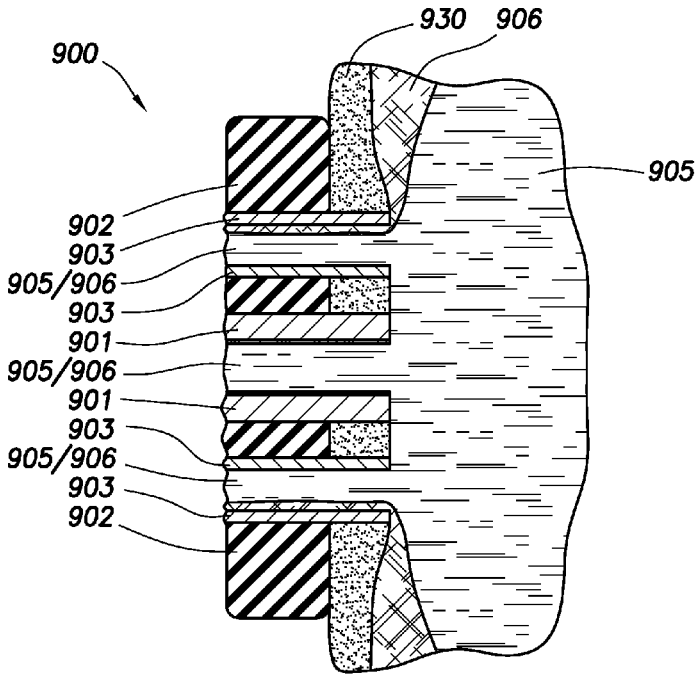
FIGS. 9A and 9B are schematic views of apparatus according to one or more aspects of the present disclosure.
Figure 9B:
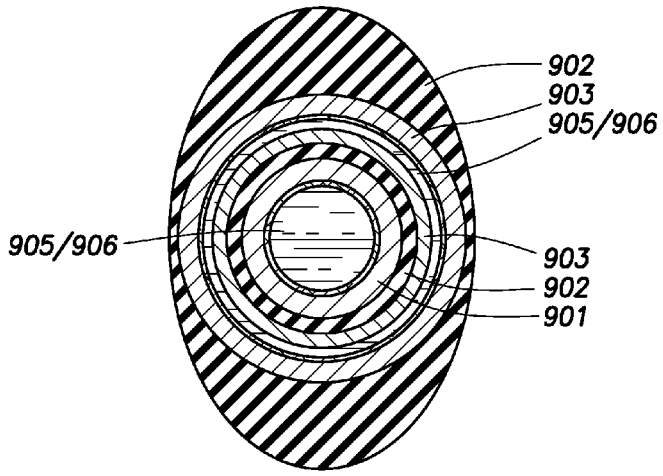

Referring to FIGS. 8A and 8B and FIGS. 9A and 9B, illustrated are schematics of probes of fluid sampling tools in accordance with one or more aspects of the present disclosure. FIGS. 8A and 8B illustrate a single probe 800 and FIGS. 9A and 9B illustrate a dual probe 900, similar to the Quicksilver probe provided by Schlumberger. Contamination measurements in accordance with the present disclosure may be used when operating fluid sampling tools having single or dual probes. Direct measurements of the level of contamination may provide accurate levels of contamination, even when using a dual probe.

Referring to FIGS. 8A and 8B, a single probe 800 is shown. The single probe 800 may include an engagement portion 802 to fluidly seal and engage with the wellbore wall. An inlet 801 may penetrate the mud cake 830 such that the inlet 801 may be in fluid communication with formation fluid 805 and/or drilling fluid filtrate (contaminant) 806 beyond the mud cake 830. When fluids are drawn into the inlet 801, the formation fluid 805 and/or contaminant 806 may be extracted from the formation. Accordingly, the fluid extracted may be a contaminated fluid, as described above. A process to determine a level of contaminants in a fluid extracted by the single probe 800 may include OCM modeling and/or direct contamination level determination as disclosed herein. Specifically, OCM modeling may provide a reasonable estimate of contamination levels as a function of time and direct measurements may be made at points of interested determined from the OCM modeling.

Referring now to FIGS. 9A and 9B, a dual probe 900 is shown. As known, low contamination samples may be obtained effectively with dual probes. The dual probe 900 may include an engagement portion 902 to fluidly seal and engage with the wellbore. The dual probe 900 may include two inlets 901 and 903. For example, as shown, dual probe 900 may include inner inlet 901 and outer inlet 903. Thus, fluid may be extracted from a formation into the inner inlet 901 at a first flow rate, and into the inlet 903 at a second flow rate different from the first flow rate. For example, as shown, formation fluid 905 and drilling fluid filtrate (contaminant) 906 may be drawn into both inner probe 901 and outer probe 903.

As a result of the multiple flow rates of the fluid extracted from the formation with the dual probe 900, modeling of the contamination over time or volume may be difficult. Additionally, the ratio of contaminant 906 to formation fluid 905 may vary between inner inlet 901 and outer inlet 903, thereby potentially making modeling even more difficult. To model fluid extraction by a dual probe, such as the probe illustrated in FIGS. 9A and 9B, more variables may be introduced in a fluid extraction model, such as the OCM model. However, a direct measurement performed in accordance with the present disclosure may be advantageously used. Accordingly, a fluid sampling tool having a dual probe may effectively be operated based on direct measurements of fluid contamination as disclosed herein.

Figure 10:
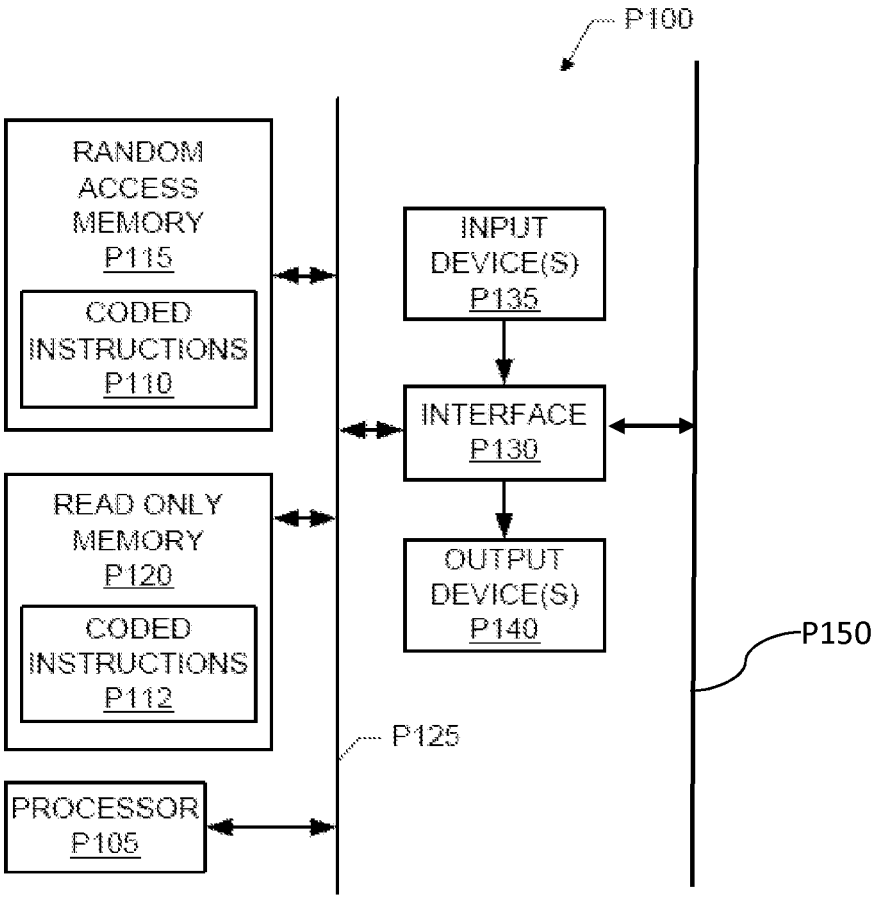
FIG. 10 is a schematic view of apparatus according to one or more aspects of the present disclosure.

FIG. 10 is a schematic view of at least a portion of an example computing system P100 that may be programmed to carry out all or a portion of the example method 700 of FIG. 7. The computing system P100 may be used to implement all or a portion of the electronics and processing system of FIGS. 1-6. Thus, the computing system P100 shown in FIG. 10 may be used to implement surface components (e.g., components located at the Earth's surface) and/or downhole components (e.g., components located in a downhole tool) of a distributed computing system.

The computing system P100 may include at least one general-purpose programmable processor P105. The processor P105 may be any type of processing unit, such as a processor core, a processor, a microcontroller, etc. The processor P105 may execute coded instructions P110 and/or P112 present in main memory of the processor P105 (e.g., within a RAM P115 and/or a ROM P120). When executed, the coded instructions P110 and/or P112 may cause the fluid sampling tools shown in FIGS. 1-6 to perform at least a portion of the method 700 of FIG. 7, among other things.

The processor P105 may be in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to store, for example, fitting parameters, contamination level, and spectra database, such as discussed herein.

The computing system P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example input device P135 may be used to, for example, collect data from the example optical spectrometer and/or detector discussed herein. The example output device P140 may be used to, for example, display, print and/or store on a removable storage media one or more contamination levels of downhole fluid samples. Further, the interface circuit P130 may be connected to a telemetry system P150, including, for example, mud pulse telemetry (MPT), wireline telemetry and/or wired drill pipe (WDP) telemetry systems as discussed in FIGS. 1-6. The telemetry system P150 may be used to transmit measurement data, processed data and/or instructions, among other things, between the surface and downhole components of the distributed computing system.

In view of all of the above and the figures, those skilled in the art should readily recognize that the present disclosure introduces a method comprising providing a fluid sample from downhole fluid extracted from a subterranean formation, applying an olefin reactant to the fluid sample to create a combined fluid, observing the combined fluid, determining if contaminants by drilling fluids are present within the fluid sample based on the observation of the combined fluid. Providing the fluid sample may comprise positioning a fluid sampling tool in a wellbore formed in the subterranean formation, and extracting the downhole fluid from the formation with the fluid sampling tool. Applying the olefin reactant to the fluid sample may comprise injecting the olefin reactant into the fluid sample. Applying the olefin reactant to the fluid sample may comprise combining the fluid sample with the olefin reactant in a fluid chamber of a fluid sampling tool. Determining if contaminants by drilling fluids are present within the fluid sample may comprise determining a presence of olefins in the fluid sample. The contaminants by drilling fluids may comprise oil based drilling mud filtrate. Observing the combined fluid may comprise observing an optical absorption of the combined fluid. Observing the optical absorption of the combined fluid may comprise observing an absorption spectrum of the combined fluid. The method may further comprise observing the fluid sample prior to applying the olefin reactant, comparing the observation of the fluid sample with the observation of the combined fluid; and the contaminants by drilling fluids may be determined as present within the fluid sample if the observation of the fluid sample differs from the observation of the combined fluid. Observing the combined fluid may comprise observing a fluorescence of the combined fluid. The olefin reactant may comprise one of the group consisting of bromine and potassium permanganate. The method may further comprise estimating a level of contamination by drilling fluids. The olefin reactant may be applied to the fluid sample when the contamination level is below a predetermined value. The olefin reactant may be applied to the fluid sample when a change of the contamination level is below a predetermined value.

The present disclosure also introduces a method comprising providing a fluid sample from downhole fluid extracted from a subterranean formation, observing a reaction between an olefin reactant and the fluid sample, and determining an amount of contaminants by drilling fluids within the fluid sample based on the observation of the reaction. The fluid sample may be a first fluid sample, and the method may further comprise pumping downhole fluid to provide a second fluid sample having a reduced amount of contaminants by drilling fluids. The fluid sample maybe a first fluid sample, and the method may further comprise determining a volume of downhole fluid to be extracted from the formation to provide a second fluid sample having a reduced amount of contaminants by drilling fluids. The method may further comprise pumping the volume of downhole fluid. Observing the reaction may comprise observing an optical absorption of the fluid sample after applying the olefin reactant to the fluid sample. Observing the optical absorption may comprise observing an optical spectrum. The olefin reactant may comprise one of the group consisting of bromine and potassium permanganate.

The present disclosure also introduces a method comprising positioning a fluid sampling tool in a wellbore formed in a subterranean formation, pumping downhole fluid from the formation with the fluid sampling tool, providing a fluid sample of the downhole fluid, observing a reaction between an oil based mud reactant and the fluid sample using a sensor of the fluid sampling tool, and determining if contaminants by drilling fluids are present within the fluid sample based on the observation of the reaction. The contaminants may comprise olefins. The oil based mud reactant may comprise one of the group consisting of bromine and potassium permanganate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising: providing a fluid sample from downhole reservoir fluid extracted from a subterranean formation; applying a reactant to the fluid sample to create a chemical reaction at a downhole wellbore location within a downhole fluid sampling tool, wherein the reactant comprises a substance, chemical, or compound that is known to react with olefin; observing the chemical reaction at the downhole wellbore location; and determining if drilling fluids are present within the fluid sample in the downhole sampling tool based on the observation of the chemical reaction at the downhole wellbore location, wherein the drilling fluids are fluids pumped to the downhole wellbore location from the Earth's surface.

2. The method of claim 1 wherein providing the fluid sample comprises:

positioning the fluid sampling tool in an open hole wellbore formed in the subterranean formation; and extracting the downhole fluid from the formation with the fluid sampling tool adjacent the downhole wellbore location.

3. The method of claim 1 wherein applying the reactant to the fluid sample comprises injecting the reactant into the fluid sample at the downhole wellbore location.

4. The method of claim 1 wherein applying the reactant to the fluid sample comprises combining the fluid sample with the reactant in a fluid chamber of a fluid sampling tool.

5. The method of claim 1 wherein determining if drilling fluids are present within the fluid sample comprises determining a presence of olefins in the fluid sample.

6. The method of claim 1 wherein the drilling fluids comprise oil based drilling mud filtrate.

7. The method of claim 1 wherein observing the chemical reaction comprises observing an optical absorption of a product of the chemical reaction.

8. The method of claim 7 wherein observing the optical absorption of the chemical reaction comprises observing an absorption spectrum of the product of the chemical reaction.

9. The method of claim 1 further comprising: observing the fluid sample prior to applying the reactant; comparing the observation of the fluid sample with the observation of the chemical reaction; and wherein the drilling fluids are determined as present within the fluid sample if the observation of the fluid sample differs from the observation of the chemical reaction.

10. The method of claim 1 wherein the reactant comprises one of the group consisting of bromine and potassium permanganate.

11. The method of claim 1 further comprising estimating a level of contamination by drilling fluids.

12. The method of claim 11 wherein the reactant is applied to the fluid sample when the contamination level is below a predetermined value.

13. The method of claim 11 wherein the reactant is applied to the fluid sample when a change of the contamination level is below a predetermined valve.

14. A method comprising:

providing, at a downhole wellbore location, a fluid sample from fluid extracted from a subterranean formation into a downhole tool;

observing a reaction between a reactant and the fluid sample at the downhole wellbore location in the downhole tool, wherein the reactant comprises a substance, chemical, or compound that is known to react with olefin; and determining, at the downhole wellbore location, an amount of contaminants in drilling fluids within the fluid sample based on the observation of the reaction, wherein the drilling fluids are fluids pumped to the downhole wellbore location from the Earth's surface.

15. The method of claim 14 wherein the fluid sample is a first fluid sample, the method further comprising pumping downhole fluid to provide a second fluid sample having a reduced amount of contaminants from the drilling fluids.

16. The method of claim 14 wherein the fluid sample is a first fluid sample, the method further comprising determining a volume of fluid to be extracted from the formation to provide a second fluid sample having a reduced amount of contaminants from the drilling fluids.

17. The method of claim 16 further comprising pumping the volume of fluid to be extracted from the formation to provide the second fluid sample.

18. The method of claim 14 wherein observing the reaction comprises observing an optical absorption of the fluid sample after applying the reactant to the fluid sample.

19. The method of claim 18 wherein observing the optical absorption comprises observing an optical spectrum.

20. The method of claim 14 wherein the reactant comprises one of the group consisting of bromine and potassium permanganate.

* * * * *